US008613266B2

(12) United States Patent
Kameda et al.

(10) Patent No.: US 8,613,266 B2
(45) **Date of Patent: *Dec. 24, 2013**

(54) CAM SHAFT PHASE VARIABLE DEVICE IN ENGINE FOR AUTOMOBILE

(75) Inventors: Michihiro Kameda, Hadano (JP); Masayasu Nagado, Hadano (JP)

(73) Assignee: Nittan Valve Co., Ltd., Hadano-shi, Kanagawa (JP)

( * ) Notice: Subject to any disclaimer, the term of this patent is extended or adjusted under 35 U.S.C. 154(b) by 323 days.

This patent is subject to a terminal disclaimer.

(21) Appl. No.: 13/062,351

(22) PCT Filed: Sep. 5, 2008

(86) PCT No.: PCT/JP2008/066082

§ 371 (c)(1), (2), (4) Date: Apr. 27, 2011

(87) PCT Pub. No.: WO2010/026645

PCT Pub. Date: Mar. 11, 2010

(65) Prior Publication Data

US 2011/0192365 A1 Aug. 11, 2011

(51) Int. Cl.
*F01L 1/34* (2006.01)

(52) U.S. Cl.
USPC ..... 123/90.17

(58) Field of Classification Search
USPC ..... 123/90.15, 90.17
See application file for complete search history.

(56) References Cited

U.S. PATENT DOCUMENTS 6,732,688 B2 * 5/2004 Yamamuro et al. ..... 123/90.17
7,143,730 B2 * 12/2006 Yamanaka ..... 123/90.17
7,228,830 B2 * 6/2007 Watanabe ..... 123/90.17
7,278,386 B2 * 10/2007 Hori et al. ..... 123/90.17
7,347,173 B2 * 3/2008 Yamanaka ..... 123/90.17
7,377,242 B2 * 5/2008 Uehama et al. ..... 123/90.17
7,383,803 B2 * 6/2008 Watanabe ..... 123/90.17
7,753,018 B2 * 7/2010 Watanabe ..... 123/90.17
7,827,948 B2 * 11/2010 Kokubo et al. ..... 123/90.17

(Continued)

FOREIGN PATENT DOCUMENTS

DE 10317607 A1 11/2003
EP 2249000 A1 * 11/2010 ..... F01L 1/344

(Continued)

*Primary Examiner* — Thomas Denion
*Assistant Examiner* — Steven D Shipe
(74) *Attorney, Agent, or Firm* — Westerman, Hattori, Daniels & Adrian, LLP

(57) ABSTRACT

[PROBLEMS]
To provide an inexpensive cam shaft phase variable device of an engine in which the displacement width of attachment angle between a crankshaft and a camshaft is large and operational sound is silent.
[MEANS FOR SOLVING PROBLEMS]
In a phase variable device of an engine for altering the phase angle between a cam shaft and crankshaft depending on the relative rotational direction of a first control body of revolution being braked by a rotary operating force imparting means, the rotary operating force imparting means comprises a brake means of the first control body of revolution, a second intermediate body of revolution rotating synchronously with the cam shaft, a second control body of revolution having a brake means, a first eccentric rotating mechanism interlocked with the first control body of revolution to perform eccentric rotation, a second eccentric rotating mechanism interlocked with the second control body of revolution to perform eccentric rotation, and a means for coupling the first and second eccentric rotating mechanisms to perform relative rotation by engaging with the substantially radial guide groove of the second intermediate body of revolution under displaceable state.

4 Claims, 9 Drawing Sheets

(56) References Cited

U.S. PATENT DOCUMENTS

| | | | | |
|---|---|---|---|---|
| 7,959,537 | B2 * | 6/2011 | Sugiura et al. | 477/176 |
| 8,061,310 | B2 * | 11/2011 | Watanabe | 123/90.15 |
| 8,286,602 | B2 * | 10/2012 | Kameda et al. | 123/90.17 |
| 8,322,319 | B2 * | 12/2012 | Nagado | 123/90.17 |
| 8,387,577 | B2 * | 3/2013 | Shiino et al. | 123/90.17 |
| 2002/0038639 | A1 * | 4/2002 | Mae et al. | 123/90.17 |
| 2002/0062798 | A1 * | 5/2002 | Iwaki et al. | 123/90.15 |
| 2002/0100444 | A1 * | 8/2002 | Todo et al. | 123/90.17 |
| 2002/0100446 | A1 * | 8/2002 | Watanabe | 123/90.17 |
| 2002/0174843 | A1 * | 11/2002 | Iwaki et al. | 123/90.17 |
| 2003/0029399 | A1 * | 2/2003 | Yamamuro et al. | 123/90.17 |
| 2003/0037740 | A1 * | 2/2003 | Watanabe | 123/90.17 |
| 2003/0070641 | A1 * | 4/2003 | Watanabe et al. | 123/90.17 |
| 2003/0070643 | A1 * | 4/2003 | Watanabe et al. | 123/90.17 |
| 2003/0131812 | A1 * | 7/2003 | Hosoya | 123/90.16 |
| 2003/0145815 | A1 * | 8/2003 | Miyakoshi | 123/90.17 |
| 2003/0226532 | A1 * | 12/2003 | Takenaka et al. | 123/90.17 |
| 2004/0182343 | A1 * | 9/2004 | Watanabe | 123/90.17 |
| 2007/0074693 | A1 * | 4/2007 | Yamanaka | 123/90.17 |
| 2007/0204825 | A1 * | 9/2007 | Watanabe | 123/90.17 |
| 2007/0295295 | A1 * | 12/2007 | Kobayashi et al. | 123/90.17 |
| 2008/0011255 | A1 * | 1/2008 | Watanabe et al. | 123/90.17 |
| 2008/0223323 | A1 * | 9/2008 | Watanabe | 123/90.17 |
| 2009/0090322 | A1 * | 4/2009 | Kokubo et al. | 123/90.17 |
| 2010/0024754 | A1 * | 2/2010 | Kameda et al. | 123/90.17 |
| 2010/0180844 | A1 * | 7/2010 | Uehama et al. | 123/90.17 |
| 2010/0313836 | A1 * | 12/2010 | Kameda et al. | 123/90.17 |
| 2011/0000450 | A1 * | 1/2011 | Shiino et al. | 123/90.17 |
| 2011/0036319 | A1 * | 2/2011 | Kameda et al. | 123/90.17 |
| 2011/0192365 | A1 * | 8/2011 | Kameda et al. | 123/90.15 |
| 2011/0226202 | A1 * | 9/2011 | Nagado | 123/90.15 |
| 2011/0308488 | A1 * | 12/2011 | Kong et al. | 123/90.17 |
| 2012/0073532 | A1 * | 3/2012 | Kameda et al. | 123/90.15 |

FOREIGN PATENT DOCUMENTS

| | | | | | |
|---|---|---|---|---|---|
| EP | 2258930 | A1 * | 12/2010 | | F01L 1/352 |
| JP | 2003129806 | A * | 5/2003 | | F01L 1/34 |
| JP | 2004-003419 | A | 1/2004 | | |
| JP | 2006-077779 | A | 3/2006 | | |
| WO | WO 2009130770 | A1 * | 10/2009 | | F01L 1/352 |
| WO | 2009-139770 | A1 | 11/2009 | | |
| WO | WO 2010026645 | A1 * | 3/2010 | | F01L 1/352 |
| WO | WO 2010046974 | A1 * | 4/2010 | | F01L 1/352 |
| WO | WO 2010140250 | A1 * | 12/2010 | | |

* cited by examiner

SECTION G-G (a)

SECTION E-E (b)

SECTION G-G

CAM SHAFT PHASE VARIABLE DEVICE IN ENGINE FOR AUTOMOBILE

TECHNICAL FIELD

This invention relates to an automobile phase varying device equipped with a camshaft and a torque means for rotating a rotary drum in the forward or backward direction relative to the coaxial camshaft to advance or retard the rotational phase of the camshaft relative to the crankshaft of the automobile engine, thereby changing the valve timing of the engine. The relative rotational direction of the camshaft to advance/retard the phase angle thereof will be referred to phase advancing/retarding direction.

BACKGROUND ART

There has been known a valve timing control device as disclosed in Patent Document 1 cited below. Patent Document 1 discloses a device for varying the phase angle of the camshaft 1 of an internal combustion engine relative to the drive plate 2 driven by the crankshaft of the engine, in the phase advancing direction (which is the same as the rotational direction of the driving plate 2) or phase retarding direction (which is opposite to the rotational direction of the driving plate 2) to vary valve timing by means of a cam (or camshaft 1).

In the device of Patent Document 1, the driving plate 2 is mounted rotatable relative to a lever shaft 13 which is fixedly coupled to a spacer 8. The lever shaft 13 has three levers 12 each of which is pivotally connected at one end thereof to one end of a link arm 14. The other end of the link arm 14 is in turn pivotally connected to a movable member 11 which can slide in a generally radial guide slit 10 formed in the front face of the driving plate 2. As the movable member 11 slides in the radially inward direction, the phase angle of the camshaft 1 is varied relative to the driving plate 2 through the rotation of the link arm 14 about a pin 16. While, when the movable member 11 slides in the radially outward direction, the link arm 14 is rotated in the opposite direction, thereby returning the phase angle of the camshaft 1.

Arranged ahead of the movable member 11 is a guide plate 24 (rotary drum) which is rotatable relative to the camshaft 1 (lever shaft 13) and drive plate 2. Rotatably supported between the recess 21 formed in the front end of the movable member 11 and spiral grooves (spiral guides) 28 formed in the rear end of the guide plate 24 are balls 22 that can roll between them. In response to the rolling motions of the balls 22 in the spiral grooves 28, the movable member 11 slides in the generally radial guide slit 10 in the radially inward or outward direction depending on the relative motion of the guide plate 24 relative to the drive plate 2.

The guide plate 24 can be rotated in the phase retarding direction relative to the drive plate 2 by the braking force of a first electromagnetic brake 26, but can be rotated in the phase advancing direction relative to the drive plate 2 by a planetary gear mechanism (reverse rotary mechanism) 25 operated by a second electromagnetic brake 27, as stated below.

The planetary gear mechanism (reverse rotary mechanism) 25 has a sun gear 30 provided on the rear end of a braking flange 34 that is rotatably mounted on the camshaft 1 (lever shaft 13) ahead of the guide plate 24, and a ring gear 31 provided on the front end of the guide plate 24. Further, the planetary gear mechanism 25 has a multiplicity of planetary gears 33 that are supported to engage the sun gear and ring gear 31 such that the gears 33 are rotatable relative to a carrier plate 32 fixed to the lever shaft 13. As the brake flange 34 is braked by the second electromagnetic brake 27, causing the planetary gears 33 to be rotated, the ring gear 31 is accelerated in the phase advancing direction, so that the guide plate 24 is rotated in the phase advancing direction relative to the drive plate 2.

In short, the device of Patent Document 1 is adapted to rotate the guide plate 24 relative to the drive plate 2 by a pair of electromagnetic brakes (26 and 27) and a planetary gear mechanism (reverse rotary mechanism) 25 and change the phase angle between the camshaft 1 and the crankshaft (drive plate 2) in accordance with the direction of the relative rotation.

Patent Document 1: JPA Laid Open 2006-77779

DISCLOSURE OF INVENTION

The device of Patent Document 1 has a drawback in that the reverse rotary mechanism of the rotary drum (guide plate) 24 is not only costly but also presents gear noise. This is due to the fact that the planetary gear mechanism 25 involves many gears including multiple planetary gears in addition to the sun gear 30 and ring gear 31. The cost of manufacturing these gears at high precisions is disadvantageously high. Further, operation of the planetary gear mechanism 25 involving many gears generate a large gear rattle, especially when the valve timing is varied.

To overcome such prior art problems as mentioned above, the inventors of the present invention is led to provide a phase varying device for an automobile engine equipped with a calm and economic reverse rotary mechanism for a rotary drum, which invention has been filed as an international patent application under the title: CAM SHAFT PHASE VARIABLE DEVICE IN ENGINE FOR AUTOMOBILE (PCT/JP2008/57857, which will be referred to as Priority Application 1).

The reverse rotary mechanism of the rotary drum of the Priority Application 1 has a first and a second control rotor (45 and 57) which are rotatably mounted on a center shaft 42 which is integral with a camshaft 40, and controlled by a first and a second electromagnetic clutches (44 and 60, respectively). The reverse rotary mechanism also has a second intermediate rotor 56 fixedly mounted on the center shaft 42 between the first and second control rotors (45 and 57).

The second control rotor 57 is provided on one end thereof facing the second intermediate rotor 56 with second spiral guide slits 62 which have radii continuously decreasing in the phase advancing direction (which is the rotational direction of a drive rotor 71, or the clockwise direction as seen from the second electromagnetic clutch 60). The first control rotor 45 is provided on one end thereof facing the second intermediate rotor 56 with first spiral guide slits having radii continuously decreasing in the phase retarding direction (that is, in the opposite counterclockwise direction relative to the drive rotor 71). The intermediate rotor 56 is provided with radial guide slits 63 perpendicular to the rotational axis of the intermediate rotor 56. A slidable pin 64 is slidably fitted in each of the guides slits (61-63).

When the second control rotor 57 is braked by the second electromagnetic clutch 60 to rotate the rotor in the phase retarding direction relative to the intermediate rotor 56, the slide pins 64 are displaced in the second guide slits 62 and in the radial guide slits 63, moving radially inwardly on the intermediate rotor. As the slide pins 64 moving radially inwardly in the first guide slits 61 exerts torques on the first control rotor 45 in the phase advancing direction, the first control rotor 45 is rotated in the phase advancing direction relative to the intermediate rotor 56, thereby changing the phase angle of the camshaft 40 (center shaft 42) relative to the crankshaft 41. On the other hand, when braked by the first electromagnetic clutch 44, the first control rotor 45 is rotated in the phase retarding direction relative to the intermediate rotor 56, thereby changing the phase angle in the phase retarding direction.

The reverse rotary mechanism of the first control rotor (rotary drum) 45 is easy to manufacture at low cost, since all of the rotors (56 and 57), slide pins 64, and guide slits (61-63) have basically simple circular shapes. The slide pins 64 are always displaced calmly in the respective guide slits (61-63), even while changing valve timing.

The variable range of the phase angle of the camshaft relative to the crankshaft (drive rotor 41) can be made larger on one hand by extending the guide slits 61 in the circumferential direction. On the other hand, then the torques exerted on the first control rotor 45 in the phase advancing direction by the slide pins 64 sliding in guide slits 61 decrease with the extended lengths of the first guide slits 61, since the relative angle between the first guide slits 61 and the radial guide slits 63 increases for the extended guide slits 61, and accordingly so does the friction between them.

It is desirable that the reverse rotary mechanism of the first control rotor (rotary drum) 45 can maintain the torque provided by the braking action of the second control rotor 57 while permitting the range of phase angle of the camshaft 40 as large as possible.

Thus, it is an object of the present invention to provide a camshaft phase variable device for an engine which is not only as calm and economic as a prior art device but also has a reverse rotary mechanism for a rotary drum that allows a large phase angle variation to the camshaft relative to the crankshaft.

Means for Solving the Problem

To achieve the object above, there is provided a camshaft phase variable device for an engine, as defined in claim 1, having: a drive rotor driven by a crankshaft of the engine; an intermediate rotor integral with a camshaft; and a first control rotor and a torque means for providing the first control rotor with a torque, the first control rotor and the torque means aligned to a common rotational axis and rotatable relative to each other, the camshaft phase variable device adapted to vary the phase angle of the camshaft relative to the drive rotor in accordance with the rotational direction of the first control rotor relative to the first intermediate rotor and the drive rotor, the camshaft phase variable device characterized in that the torque means comprises:

a first brake means for causing the first control rotor to be rotated relative to the first intermediate rotor and the drive rotor;

a second intermediate rotor integral with the camshaft and having a substantially radial guide slit (hereinafter simply referred to as radial guide slit);

a second control rotor mounted coaxial with, and rotatable relative to, the first control rotor and second intermediate rotor, the second control rotor rotated by a second control means relative to the first control rotor and second intermediate rotor;

a first eccentric rotary mechanism that rotates eccentrically about the rotational axis in conjunction with the first control rotor;

a second eccentric rotary mechanism that rotates eccentrically about the rotational axis in conjunction with the second control rotor; and coupling means in sliding engagement with the radial guide slit for coupling the first and second eccentric rotary mechanisms mutually rotatable with respect to each other, so that when one of the first and second control rotors is rotated, the other one is rotated relative to that one.

(Function)

Under the initial condition, the first control rotor rotates together with the first intermediate rotor which is integral with the camshaft, and with drive rotor driven by the crankshaft. Upon receiving a braking force exerted by the first brake means, the first control rotor is rotated in the phase retarding direction relative to the drive rotor and the first intermediate rotor. But when the second control rotor is braked by the second brake means, the first control rotor is rotated in the phase advancing direction relative to the drive rotor and first intermediate rotor, that is, in the direction opposite to rotation caused by the first brake means. The phase angle of the first intermediate rotor (rotated by the camshaft) relative to the drive rotor (rotated by the crankshaft) is advanced (rotated in the same rotational direction as the drive rotor) or retarded (rotated in the direction opposite to the drive rotor) depending on the rotational direction of the first control rotor.

On the other hand, the first eccentric rotary mechanism rotates together with the first control rotor, while the second control rotor and second eccentric rotary mechanism are rotated together relative to the second intermediate rotor which is integrated with the first control rotor and camshaft by the second brake means. When one of the first and the second eccentric rotary mechanisms rotates, the coupling means is radially displaced in the radial guide slit of the second intermediate rotor, causing the other eccentric rotary mechanism to rotate in the opposite direction. In other words, when the second control rotor is braked, the first control rotor is rotated by the first and second eccentric rotary mechanism in the direction opposite to the rotation caused by the first brake means.

The coupling means reciprocate in the guide slit as if the coupling means were one of the four nodes of a quadric link mechanism linking:

the coupling means with the eccentric point of the first eccentric rotary mechanism offset from the rotational axis;

the eccentric point of the first eccentric rotary mechanism with the rotational axis;

the rotational axis with the eccentric point of the second eccentric rotary mechanism; and the eccentric point of the second eccentric rotary mechanism with the coupling means. At the same time, as the coupling means reciprocates, the eccentric points of the first and second eccentric rotary mechanisms, appearing as the nodes of the quadric link system, rotate smoothly in the opposite directions about the rotational axis. Thus, if one of the first and second control rotors, adapted to rotate together with the first and second control rotors, is set in rotational motion in one direction, the other one is also set in a smooth rotational motion in the opposite direction.

On the other hand, the variable range of phase angle of the camshaft relative to the crankshaft can be made larger by extending the radial guide slit or by extending the range of the reciprocal motions of the first and second eccentric rotary mechanisms.

It should be appreciated that the first and second control rotors, second intermediate rotor, first and second eccentric rotary mechanisms, and coupling means have basically simple, circular, and hence easy-to-work, configurations. It is noted that the coupling means remains in contact with the respective guide slits while it is displaced in the slits to change the phase angle of the first intermediate rotor relative to the drive rotor.

To achieve the object above, the camshaft phase variable device of claim 1 may be provided, as defined in claim 2, such that:

the eccentric rotary mechanism has a first circular eccentric bore formed in the first control rotor, and a first ring member having an outer circumference in sliding contact with the inner circumference of the first circular eccentric bore, while the second eccentric rotary mechanism has a second circular eccentric bore formed in the second control rotor, and a second ring member having an outer circumference in sliding contact with the inner circumference of the second eccentric bore;

the coupling means has a first and a second engagement bores formed in the first and second ring members, respectively, and a coupling member passing through the radial guide slit with the opposite end thereof inserted in the first and second engagement bores, respectively, the first and second ring members are arranged across the phantom extension line of the radial guide slit.

(Function)

The first and second ring members undergo eccentric rotations about the rotational axes of the respective control rotors together with the first and second control rotors, respectively, while sliding in the first and second circular eccentric bores, respectively. When one of the first and second control rotors is braked, the ring member of the braked control rotor slides in one circular eccentric bore, causing one coupling member to move in the radial guide slit, and, via the other ring member coupled therewith, causes the other control rotor to rotate in the opposite rotational direction. The eccentric points of the first and the second ring members slide in the respective first and second circular eccentric bores of the first and second ring members rotating in opposite directions. As a result of the movement of the coupling member in the radial guide slit, these eccentric points rotate smoothly like the nodes of a quadric link mechanism. Accordingly, the first and second control rotors rotate in the opposite directions. It is noted that the ring members, eccentric bores, and coupling member are generally circular in shape that they are easy to manufacture and that they operate calmly.

To achieve the object above, the camshaft phase variable device of claim 2 may be configure, as defined in claim 3, such that the first circular eccentric bore of the first control rotor has a larger distance from the rotational axis to the center axis (eccentric point) of the first circular eccentric bore (the distance being the eccentric radius with respect to the rotational axis) than the distance from the rotational axis to the center axis (eccentric point) of the second circular eccentric bore of the second control rotor (the latter distance being the eccentric radius of the second circular eccentric bore).

(Function)

In general, when the second control means is disposed coaxial with, and radially inside of, the first control means, the radius of the second control rotor to be braked by the second brake means (hereinafter such radius will be referred to as braking radius of the rotor) is smaller than the braking radius of the first control rotor to be braked by the first brake means. Hence, unless the second brake means provides the first control rotor with a larger torque in the reverse direction than the first brake means, the operational speeds of the first control rotor in the phase advancing direction and in the phase retarding direction are different.

In the phase variable device of claim 3, the eccentric radius of the first ring member (distance from the rotational axis of the first ring member to the rotational axis of the first control rotor) is larger than the eccentric radius of the second ring member (from the rotational axis of the second ring member to the rotational axis of the second control rotor), so that the distance traveled by the center of the first ring member during the rotation of the second ring member is larger than the distance traveled by the center of the second ring member. As a consequence, while decreasing the braking torque of the second brake means that acts on the second control rotor, the phase variable device of claim 3 can provide the first control rotor with the torque having the same magnitude in the reverse direction as the torque given by the first control means. Thus, the relative rotational speeds of the first control rotor can be equalized in the phase advancing and retarding directions.

At least one of the first and second ring members of the camshaft phase variable device of claim 2 or 3 may be partly cut away to have a C-shape (the cut away portion referred to as escapement), as defined in claim 4.

(Function)

When the ring member is C-shaped, the eccentric radii of the first and second ring members can be made larger, since the ring member having such escapement can avoid collision with the center shaft.

The length of the radial guide slit of the camshaft phase variable device defined in any one of claims 2-4 may be extended to allow the second ring member to rotate 360 degrees in the second circular eccentric bore, as defined in claim 5.

(Function)

When the second control rotor can rotate 360 degrees, the shaft of the first control rotor can reciprocate from one end of the radial guide slit to the other end, undergoing rotations in both the phase advancing direction and retarding directions relative to the drive rotor. In other words, the second brake means and second control rotor can independently rotate the first control rotor both in the phase advancing and phase retarding directions, thereby advancing or retarding the phase angle of the camshaft in either direction relative to the crankshaft.

Results of the Invention

In the camshaft phase variable device of claims 1 and 2 the torque means of the first control rotor can widen the variable range of phase angle of the camshaft relative to the crankshaft without reducing the torque of the first control rotor provided by the second control rotor. Since the elements of the torque means are of generally circular configuration, the torque means can operate calmly during a phase angle variation. Further, the torque means can be manufactured easily at low cost.

The second brake means of the camshaft phase variable device as defined in claim 3 has the same braking performance as the first brake means, although the second brake means disposed inside the first brake means seemingly provides a smaller torque than the first brake means.

In the camshaft phase variable device as defined in claim 4, the first and second rings have a larger degree of freedom in setting up their eccentric radii. Accordingly, the phase angle of the camshaft relative to the crankshaft may be varied over a still larger range.

In the camshaft phase variable device as defined in claim 5, it is possible to provide the device with a fail-safe function for varying the phase angle of a camshaft relative to the crankshaft in both the phase advancing direction and retarding directions by employing only one control rotor and one brake means, should one of the two brake means have failed.

BEST MODE FOR CARRYING OUT THE INVENTION

The invention will now be described in detail with reference to embodiments 1 through 3.

FIG. 1 is an exploded perspective view of a camshaft phase variable device for automobile engine in accordance with the first embodiment of the invention, as seen from the front.

FIG. 2 is a front view of the device.

FIG. 3 shows an axial cross section of the device taken along line A-A of FIG. 2.

FIG. 4 shows radial cross sections of the device having no phase change, taken at different axial positions. More particularly, Fig. (a) shows a cross section taken along line B-B, Fig. (b) the cross section taken along line C-C, and Fig. (c) the cross section taken along line D-D of FIG. 3.

FIG. 5 shows cross sections of the device after a phase change, taken along the same lines as in FIG. 4.

FIG. 6 shows radial cross sections of the device having no phase change. More particularly, Fig. (a) shows the cross section taken along line E-E of FIG. 3, Fig. (b) cross section taken along line F-F of FIG. 3, and Fig. (c) cross section taken along line G-G.

FIG. 7 shows cross sections of the device after a phase change, taken along the same lines as in FIG. 6.

FIG. 8 is a cross sectional view of the camshaft phase variable device in accordance with the second embodiment, the figure taken along line G-G of FIG. 3 to show the first ring member and the first circular eccentric hole.

FIG. 9(*a*) shows a cross section of the camshaft phase variable device in accordance with the third embodiment taken along line E-E of FIG. 3, showing the second ring member and the second circular eccentric hole of the device. FIG. 9(*b*) shows a cross section of the camshaft phase variable device in accordance with the third embodiment taken along line G-G of FIG. 3, showing the first ring member and the first circular eccentric hole.

In use the camshaft phase variable device of the invention is installed integral with an engine. The device is adapted to transmit the rotational motion of the crankshaft to a camshaft so as to open/close an intake valve/exhaust valve and to vary the valve timing of the intake valve/exhaust valve in accordance with such operating conditions as the load and rpm of the engine.

Referring to FIGS. 1-7, there is shown a device in accordance with the first embodiment of the invention. For convenience, the term "front" section refers to the section of the device having a second electromagnetic clutch 90 (described below), while the section having a sprocket 71*a* will be referred to as the "rear" section. The device is provided with: a drive rotor 71 driven by the crankshaft (not shown) of the engine; a center shaft 72 fixedly mounted on a camshaft (not shown) for rotatably supporting the drive rotor 71; an intermediate rotor 73 mounted on the center shaft 72 ahead of the drive rotor 71 such that the intermediate rotor 73 is unrotatable relative to the center shaft 72 but rotatable relative to the drive rotor 71; a first control rotor 74 with its circumference supported by the drive rotor 71 such that the first control rotor 74 is rotatable relative to the center shaft 72 without touching the center shaft 72; and a first electromagnetic clutch 75 securely fixed to an engine case (not shown), for braking the first control rotor 74, the axes of the elements 72 through 75 all aligned to the same rotational axis L1 of the camshaft.

The first control rotor 74 has on the backside thereof a circular eccentric cam 76 (FIGS. 3 and 4(*a*)) that rotates together with the control rotor 74 about the rotational axis L1. The intermediate rotor 73 is provided on the front end thereof with a cam guide 77 that receives thereon a circular eccentric cam 76. As the circular eccentric cam 76 rotates, the intermediate rotor 73 reciprocates in the direction perpendicular to both the rotational axis L1 and the wall of the cam guide 77.

The camshaft (not shown) is integrally coupled to the camshaft by securely fixing the leading end of the center shaft 72 in the bore 72*a* formed in the trailing end of the center shaft 72. The drive rotor 71 consists of the sprocket 71*a* and a drive cylinder 71*b* coupled together with a plurality of pins 78. The center shaft 72 has a cylindrical section 72*c* formed behind a flange 72*b* of the center shaft 72. The drive rotor 71 is rotatably mounted on the coaxial center shaft 72 by fitting the cylindrical section 72*c* in the hole 71*c* of the sprocket 71*a*. The drive cylinder 71*b* has a closed bottom having a guide slit system 79 consisting of a pair of curved guide slits extending in substantially the circumferential direction about the rotational axis L1. The guide slit system 79 includes a pair of guide slits 79*a* and 79*b* formed in the opposite sides of the rotational axis, each extending in the rotational direction D1 of the drive rotor 71 (which is the clockwise direction as seen from the front end of the device) with their radii continuously decreasing radially inwardly, as shown in FIG. 4. It should be understood that the radially inwardly decreasing guide slits 79*a* can extend in the counterclockwise direction D2 with decreasing radii, as described later.

The first intermediate rotor 73 is generally a disk having a pair of faces perpendicular to the rotational axis L1. The first intermediate rotor 73 is provided on the front face thereof with a cam guide 77 adapted to receive thereon the circular eccentric cam 76. The cam guide 77 has a bottom face perpendicular to the rotational axis L1 and the front side. The bottom face has a generally square elongate hole 80. The first intermediate rotor 73 is mounted on the flat engaging face 72*d* of the center shaft 72 unrotatably relative to the center shaft 72, but is supported by the center shaft 72 slidable in the longitudinal direction of the generally square elongate hole 80.

The first intermediate rotor 73, first control rotor 74, and circular eccentric cam 76 are arranged inside the drive cylinder 71*b*. The first control rotor 74 is provided at the center thereof with a through-hole 74*a* for allowing the cylindrical section 72*e* of the center shaft 72 to pass through it without touching it. The circular eccentric cam 76 integrally formed on the rear face of the first control rotor 74 has a rotational axis L2 offset from the rotational axis L1 by a distance do. The first control rotor 74 is also a disk having an outer circumference 74*b*, which is set to be in substantial contact with, and supported by, the stepped inner circumference 71*d* formed inside the drive cylinder 71*b*.

The first control rotor 74 is supported by the drive cylinder 71*b* such that the cylindrical section 72*e* of the center shaft 72 never touches the periphery of the circular through-hole 74*a*. When the camshaft is subjected to an external torque disturbance, the circular eccentric cam 76 is acted upon by a force exerted by the cam guide 77 in the direction perpendicular to the rotational axis L1. In that event, the first control rotor 74 is moved in the direction perpendicular to the rotational axis L1, and its outer circumference 74*b* comes into contact with the inner circumference 71*d* of the drive cylinder 71*b*. As a consequence, in the cam phase variable device of the first embodiment, the frictional force acting on the inner circumference 71*d* provides a self-lock function for preventing an inadvertent change in phase of the phase variable device caused by the external torque disturbance. It is noted that when the first control rotor 74 is self-locked, it will not touch the cylindrical section 72*e* if moved in the direction perpendicular to the rotational axis L1, since there is a sufficient gap provided between the through-hole 74*a* and cylindrical section 72*e* of the center shaft 72. In this way, a positive self-lock function takes place between the outer circumference 74*b* and the inner circumference 71*d*. It should be understood that, although the circular eccentric cam 76 has a circular profile, its profile is not limited to a circle as shown in this example, and it can be of any profile.

The first intermediate rotor 73 has a pair of engagement bores 73*a* and a pair of rod members 81 each protruding rearward from the respective engagement bores 73*a*. Each of the rod members 81 is formed of a thinner hollow shaft 81*a* inserted in a thicker cylindrical shaft 81*b*. The thinner hollow shafts 81*a* engages the engagement bores 73*a*, while the thicker cylindrical shaft 81*b* are movably fitted in a pair of substantially circular guide slits 79*a* and 79*b* formed in the drive cylinder 71*b*.

Arranged ahead of the first control rotor 74 is a first electromagnetic clutch 75, which has on the rear end thereof a friction member 82. When the coil 75*a* of the first electromagnetic clutch 75 is energized, the contact face 74*c* of the first control rotor 74 is brought into sliding contact with a friction member 82 to brake the first control rotor 74 in rotation.

Mounted ahead of the first control rotor 74 are a first ring member 83, a second intermediate rotor 84, rod members 85, a second ring member 86, a second control rotor 87, a shim 88, a holder 89, and a second electromagnetic clutch 90. Together with the first electromagnetic clutch 75, members 83 through 90 constitute a torque means as defined in claim 1.

The first control rotor 74 is a generally hollow cylinder having a bottom, wherein the bottom has a stepped first circular eccentric bore 74*d* whose center axis L2 is offset from the rotational axis L1 by a distance d1. The first ring member 83 is slidably fitted in the first circular eccentric bore 74*d*. The first ring member 83 has a first engagement hole 83*a*.

The second intermediate rotor 84 is provided at the center thereof with a square hole 84*a* and a radial guide slit 84*b* outside the square hole 84*a*. The second intermediate rotor 84 is securely fixed to the center shaft 72 by fitting the second flat engagement faces 72*f* and 72*g* of the center shaft 72 in the square hole 84*a*.

The second control rotor 87 is rotatably mounted on the center shaft 72 by fitting the small cylindrical section 72*h* formed at the leading end of the center shaft 72 in the circular hole 87*a* formed at the center of the second control rotor 87. The second control rotor 87 is provided in the rear end thereof with a stepped circular eccentric bore 87*b*, whose center axis L3 is offset from the rotational axis L1 by a distance d1 in a manner similar to the first circular eccentric bore 74*d*. Slidably fitted in the second circular eccentric bore 87*b* is the second ring member 86. The second ring member 86 is provided on the rear end thereof with a second engagement hole 86*a*.

The rod members 85 comprises a thin shaft 85*a* which is coaxially fitted in a thick hollow shaft 85*b*. The opposite ends of the thin shaft 85*a* are slidably fitted in the first and second engagement holes 83*a* and 86*a*, respectively. The thick hollow shaft 85*b* is movably fitted in the radial guide slit 84*b* so that the shaft 85*b* can move in the radial direction of the second intermediate rotor 84.

The first and second ring members 83 and 86 are rotatably fitted in a first and a second circular eccentric holes 74*d* and 87*b*, respectively, such that the center axes L2 and L3 of the first and second ring members 83 and 86, respectively, are located symmetrically across the phantom extension line L4 of the radial guide slit 84*b*.

The shim 88 is fitted inside the stepped circular bore 87*c* formed in the front end thereof. A holder 89 is mounted on the small cylindrical section 72*h* of the center shaft 72 that protrudes forward from the circular hole 87*a*. Those elements between the holder 89 and the drive cylinder 71*b* are securely fixed on the camshaft (not shown) by screws inserted from front into their central holes. The second electromagnetic clutch 90 is securely fixed to the engine casing (not shown) in front of the front end of the second control rotor 87. When the coil 90*a* is energized, the second electromagnetic clutch 90 attracts the contact face 87*d* provided on the front end of the second control rotor 87 onto the friction member 91 so as to brake the rotational motion of the second control rotor 87.

It is preferable to make the contact face 87*d* of the second control rotor 87 flush with the contact face 74*c* of the first control rotor 74 as shown in FIG. 3, since if the second control rotor 87 is disposed inside the coil 75*a*, the second control rotor 87 can be also magnetized and become instabilized by the first electromagnetic clutch 75 in braking operation.

The rod members 81 and 85 may be configured to have bearings or may be replaced by balls so that they can roll in the guide slits 79 and radial guide slit 84*b* as they move. Then, the rod members 81 and 85 can move much easier with reduced friction, thereby saving electric energy which is otherwise consumed by the electromagnetic clutches.

Preferably, the second intermediate rotor 84 is made of a non-magnetic material. When the second intermediate rotor 84 is made of a non-magnetic material, it prevents the magnetic field attracting one of the control rotors 74 and 87 from being transmitted to the other control rotor via the second intermediate rotor 84.

Referring to FIG. 1 and FIGS. 4-7, operation of the camshaft phase variable device will be described in a case where the relative phase angle between the drive rotor 71 and the camshaft (not shown) is varied. When the drive rotor 71 is in phase with the camshaft (not shown) under the initial condition and rotates in the clockwise direction D1 as viewed from the front end of the device, the first intermediate rotor 73, control rotor 74 (circular eccentric cam 76), intermediate rotor 84, and control rotor 87 rotates together with the drive rotor 71 in the same clockwise direction D1.

To advance the phase angle of/the camshaft (in the clockwise direction D1) relative to the drive rotor 71/, the second control rotor 87 is braked by the second electromagnetic clutch 90. If the second electromagnetic clutch 90 is enabled, the first and second ring members 83 and 86 move from the positions shown in FIG. 6 to the positions shown in FIG. 7. That is, the second control rotor 87 gets retarded in phase, that is, rotated in the counterclockwise direction D2 (as viewed from the front end of the device), relative to the second intermediate rotor 84 and first control rotor 74. In that event, as the second ring member 86 slides in the circular eccentric bore 87*b* in D1 direction, the rod members 85 moves in the radial guide slit 84*b* radially inwardly (that is, in D3 direction as shown in FIG. 7(*b*)). As the rod members 85 moves radially inwardly in the radial guide slit 84*b*, the first ring member 83 exerts a torque on the first control rotor 74 in D1 direction while sliding in the first circular eccentric bore 74*d* in D2 direction. The first control rotor 74 rotates in the phase advancing direction (D1 direction) relative to the second intermediate rotor 84 and second control rotor 87.

At the same time, the first control rotor 74 rotates in D1 direction relative to the first intermediate rotor 73 and drive rotor 71, while the circular eccentric cam 76 integral with the first control rotor 74 eccentrically rotates in the clockwise direction D1 about the center axis L1 as shown in FIG. 4. As the circular eccentric cam 76 undergoes an eccentric rotation while sliding on the inner circumference of the cam guide 77, the first intermediate rotor 73 and the rod member 81 go downward in the longitudinal direction D3 of an elongate square hole 80 as shown in FIG. 4.

As the rod members 81 goes down, the first intermediate rotor 73 is displaced in the D1 direction along the guide slits 79*a* and 79*b*, so that the first intermediate rotor 73 rotates in D1 direction relative to the drive rotor 71, thereby displaced from the position shown in FIG. 4 to the position shown in FIG. 5. As a consequence, the phase angle of the camshaft (not shown) in phase with the rotating intermediate rotor 73 is varied in phase advancing direction D1 relative to the phase angle of the drive rotor 71.

On the other hand, to return the phase angle of the camshaft in the phase retarding direction D2 relative to the drive rotor 71, the first electromagnetic clutch 75 is activated to put the brake on the first control rotor 74. Then the circular eccentric cam 76 integral with the braked first control rotor 74 is rotated in the counterclockwise direction D2 relative to the drive rotor 71 and first intermediate rotor 73 as shown in FIG. 5, thereby moving the first intermediate rotor 73 and rod members 81 in the upward direction D4 as shown in FIG. 5. As the rod members 81 are moved upward, the first intermediate rotor 73 is displaced in the guide slit system 79 in D2 direction and hence rotated in D2 direction relative to the drive rotor 71, thereby returning from the position shown in FIG. 5 to the position shown in FIG. 4. As a consequence, the phase of the camshaft rotating in synchronism with the first intermediate rotor 73 is retarded in D2 direction relative to the drive rotor 71 driven by the crankshaft.

Referring to FIG. 8, there is shown a cam phase variable device in accordance with the second embodiment of the invention.

As shown in FIG. 6(*a*), both the eccentric radii of the first circular eccentric bore 74*d* (also of the first ring member 83) and the eccentric radii of the second circular eccentric bore 87*b* (also of the second ring member 86) are set equal to d1 in the first embodiment. In the second embodiment, the eccentric radius d2 of the first control rotor 74 as measured from the rotational axis L1 of the first control rotor 74 to the center axis L2' of a first circular eccentric bore 92 (also of the first ring member 93) is set larger than the eccentric radius d1 (FIG. 6(*a*)) of the second circular eccentric bore 87*b* (also of the second ring member 86), as shown in FIG. 8.

Incidentally, the first ring member 93 is arranged in the first circular eccentric bore 92 such that the phantom extension line L4 of the radial guide slit 84*b* (FIG. 6(*b*)) lies between the center axis L2' of the first ring member 93 and the center axis L3 of the second ring member 86. The second embodiment has the same structurally as the first embodiment except for the first circular eccentric bore 92 and the first ring member 93.

In the second embodiment, the center axis L3 of the second ring member 86 is also eccentrically rotated (as an eccentric point) about the rotational axis L1. The center axis L2' of the first ring member 93 is also eccentrically rotated (as an eccentric point) by the second ring member 86 about the rotational axis L1. However, due to the fact that the eccentric radius d2 of the first ring member 93 (FIG. 8) is larger than the eccentric radius d1 of the second ring member 86 (FIG. 6(*a*)), the center axis L2' has a larger torque radius than the center axis L3. That is, the torque acting on the first ring member 93 is larger than the torque acting on the second ring member 86. As a consequence, if in the second embodiment the torque given to the second control rotor 87 by the second electromagnetic clutch 90 is reduced, the torque given to the first control rotor 74 can be sufficiently large that the second brake means can provide as good braking as the first brake means, although the second brake means then provides an seemingly insufficient torque to the second control rotor 87. It is noted that the use of a smaller second electromagnetic clutch 90 inside the first electromagnetic clutch 75 enables provision of a compact phase variable device.

Referring to FIG. 9, there is shown a phase variable device in accordance with the third embodiment of the invention. In the third embodiment, the first and second ring members 94 and 95 are C-shaped as shown in FIG. 9. This can be done by partly cutting away a portion of each circular ring member (83 and 86) of the first embodiment. The second ring members 83 and 86 would interfere with the center shaft 72 if their eccentric radii d1 were too large. In the third embodiment, the first and second ring members are partly cut away to make them C-shaped, so that the cut-away portion serves as an escapement for the center shaft 72 to avoid said interference. Accordingly, it is possible to make the eccentric radii d3 of the first and second ring members 94 and 95 still larger to provide the first control rotor 74 with a larger torque of the second electromagnetic clutch 90. Preferably, the cut-away portion of the first and second ring members are angularly less than 180 degrees of the entire ring.

It is noted that the second ring members 83 of the first and second embodiments can rotate in the second circular eccentric bore 87*b* 360 degrees or more if the length of the radial guide slit 84*b* is sufficiently long. In that case, when the second control rotor 87 rotates 360 degrees for example, the first control rotor 74 is rotated in both the phase advancing direction and phase retarding directions relative to the drive rotor 71, since the rod members 85 reciprocates from one end to the other of the radial guide slit 84*b*. In this configuration, therefore, the phase angle of the camshaft can be varied in the phase advancing direction as well as in the phase retarding direction relative to the crankshaft solely by the second electromagnetic clutch 90.

In the first and second embodiments, the second ring member 86 is made rotatable 360 degrees or more in the second eccentric bore 87*b*. Similarly, based on the same principle, it is possible to allow the first ring member (83 and 93) to rotate 360 degrees or more in the first circular eccentric bore (74*d* and 92). In this case, the outer diameter of the circular eccentric cam 76 is made large enough to allow its rotation through 360 degrees in the cam guide 77. In this configuration, since the rod members 81 reciprocates between the opposite ends of the radial guide slit 79 as the first control rotor 74 rotates 360 degrees, the phase angle of the camshaft can be varied in the phase advancing direction as well as in the retarding direction relative to the crankshaft solely by means of the first electromagnetic clutch 75. In other words, should one of the first and second electromagnetic clutches 75 and 90, respectively, have failed, it is possible to activate the other one as a fail-safe system to vary the phase angle of the camshaft relative to the crankshaft in both the phase advancing direction and phase retarding directions.

NOTATIONS

Figure 1:
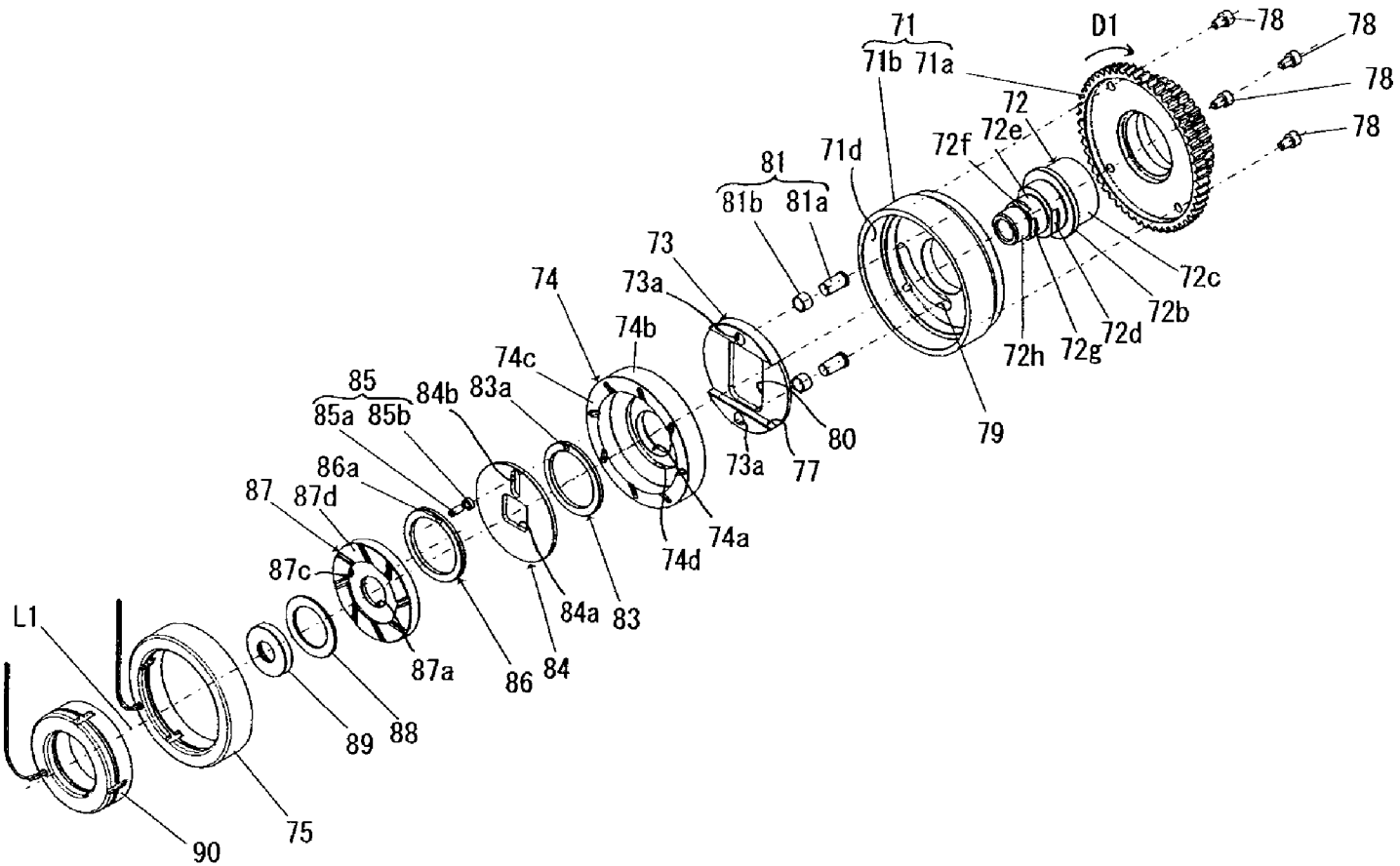
FIG. 1 is an exploded perspective view of a camshaft phase variable device for automobile engine in accordance with the first embodiment of the invention, as seen from the front.
Figure 2:
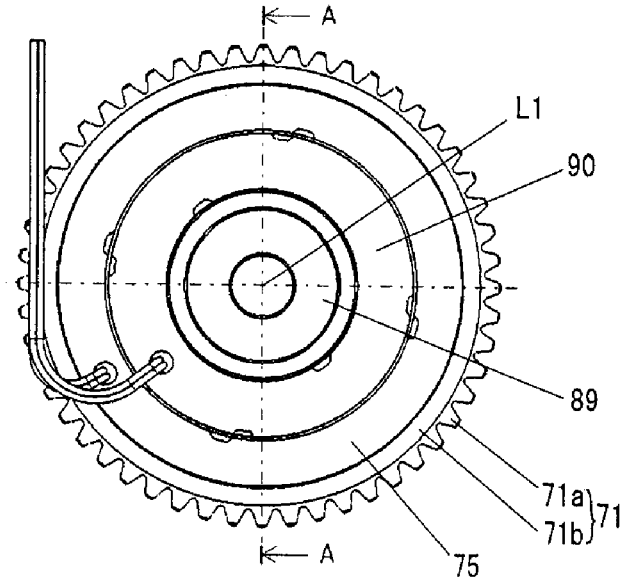
FIG. 2 is a front view of the device.
Figure 3:
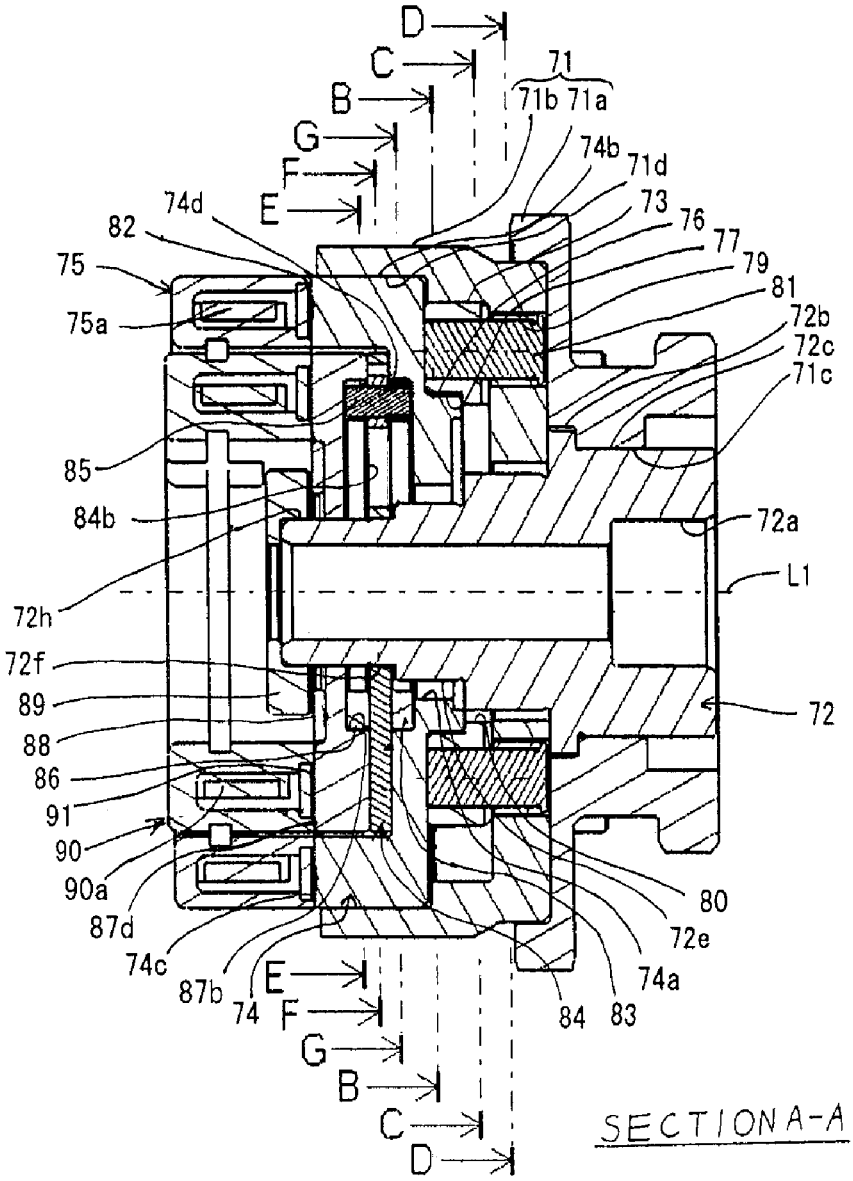
FIG. 3 is an axial cross sectional view of the device taken along line A-A of FIG. 2.
Figure 4:
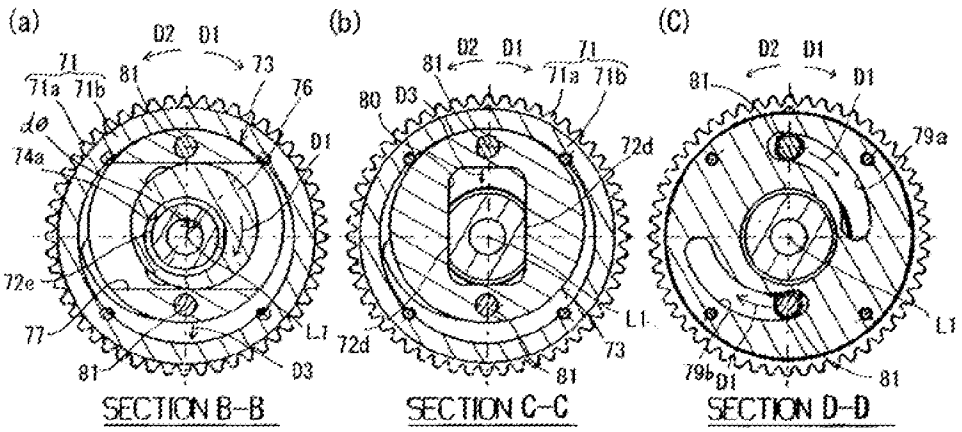
FIG. 4 shows radial cross sections of the device before undergoing a phase change. More particularly, Fig. (a) shows a cross section taken along line B-B of FIG. 3; Fig. (b) the cross section taken along line C-C; and Fig. (c) the cross section taken along line D-D of FIG. 3.
Figure 5:
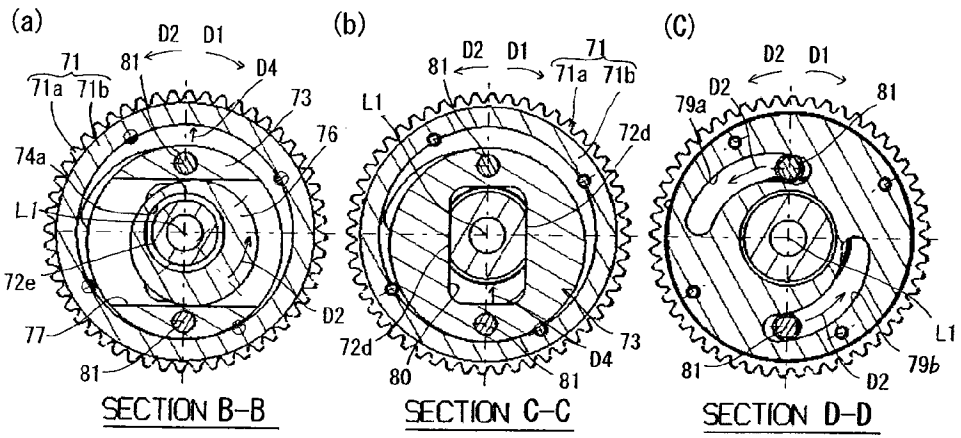
FIG. 5 shows in cross section conditions of the portions shown in FIG. 4, after undergoing a phase change.
Figure 6:
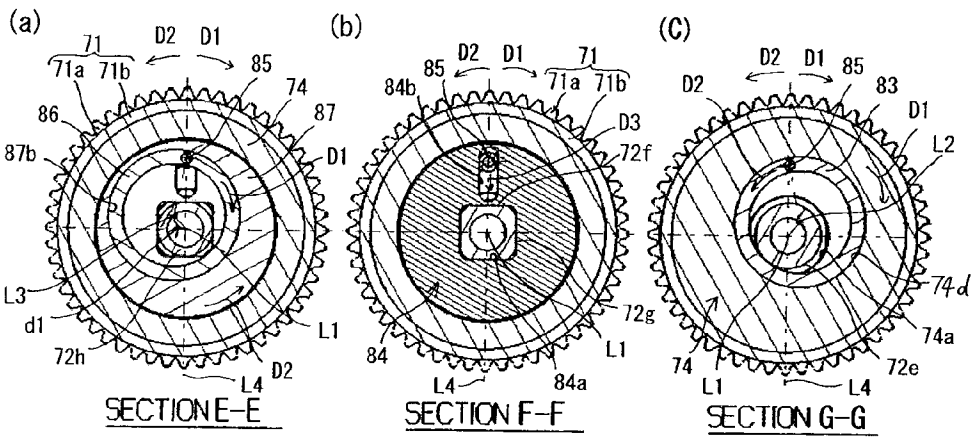
FIG. 6 shows radial cross sections of the device before undergoing any phase change. More particularly, Fig. (a) shows the cross section taken along line E-E of FIG. 3, Fig. (b) cross section taken along line F-F of FIG. 3, and Fig. (c) cross section taken along line G-G.
Figure 7:
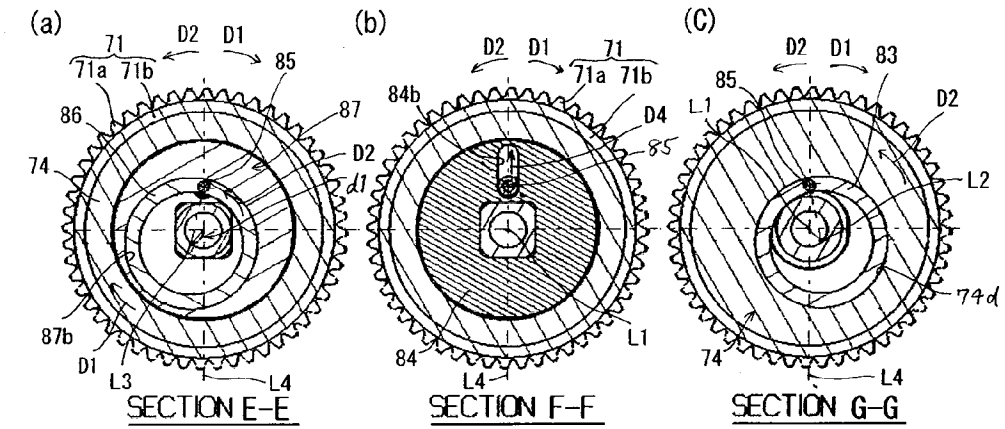
FIG. 7 shows the conditions of the portions shown in cross sections after a phase change.
Figure 8:
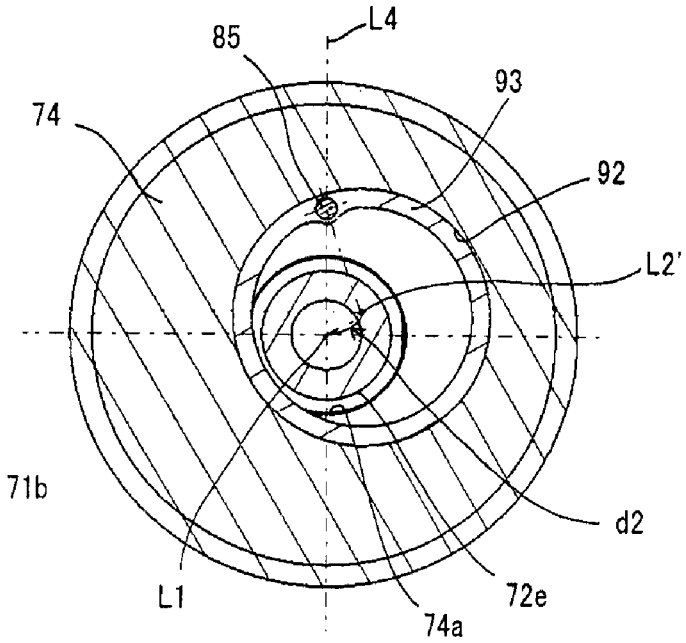
FIG. 8 is a cross sectional view of the camshaft phase variable device in accordance with the second embodiment taken along line G-G of FIG. 3, showing the first ring member and the first circular eccentric hole.
Figure 9:
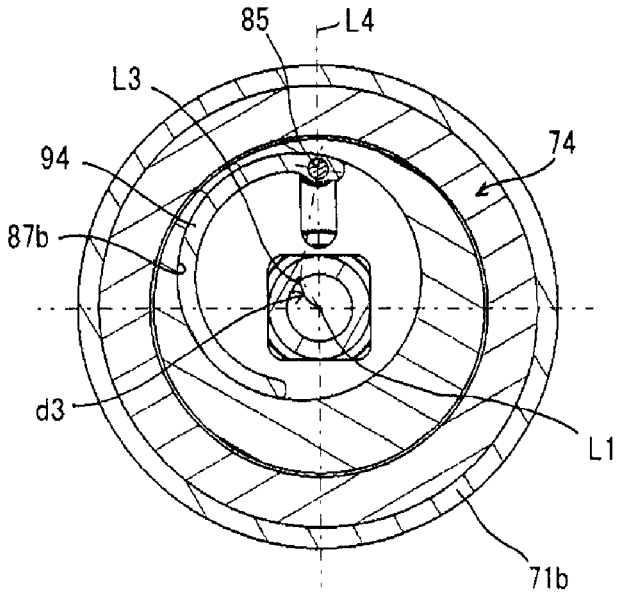
FIG. 9(*a*). is a cross sectional view of the camshaft phase variable device in accordance with the third embodiment of the invention taken along line E-E of FIG. 3, showing the second ring member and the second circular eccentric hole. Fig. (b) is a cross sectional view of the camshaft phase variable device in accordance with the third embodiment of the invention taken along line G-G of FIG. 3, showing the first ring member and the first circular eccentric hole.
Figure 9:
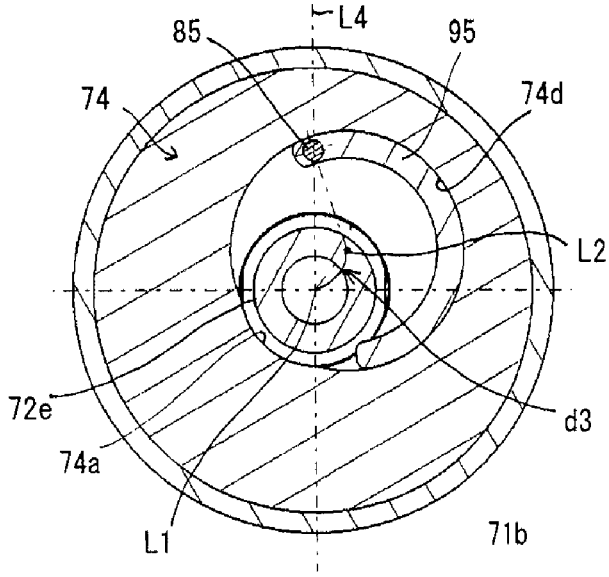

71 drive rotor
72 center shaft (integral with camshaft)
73 first intermediate rotor
74 first control rotor
74*d* first circular eccentric bore (first eccentric rotary mechanism)
75 first electromagnetic clutch (first brake means)
83,93,95 first ring members (first eccentric rotary mechanism)
83*a* first engagement bore (coupling means)
84 second intermediate rotor
84*b* substantially radial guide slit
85 rod members (coupling means)
86 and 94 second ring members (second eccentric rotary mechanism)
86*a* second engagement hole (coupling means)
87 second control rotor
87*b* second circular eccentric bore (second eccentric rotary mechanism)
90 second electromagnetic clutch (second brake means)
L1 rotational axis
L2 rotational axis of first circular eccentric bore
L2' rotational axis of first ring member
L3 center axis of second circular eccentric bore and second ring member.
L4 phantom extension line of radial guide slit
d1 and d3 eccentric radii of first and second eccentric bores.
d3 eccentric radius of first and second ring members (94 and 95)
d2 eccentric radius of first circular eccentric bore
D1 phase advancing direction (rotational direction of drive rotor)
D2 phase retarding direction (direction opposite to the rotational direction of drive rotor)

The invention claimed is:

1. A camshaft phase variable device for an engine, comprising:

a drive rotor driven by the crankshaft of the engine;

a first intermediate rotor integral with a camshaft; and a first control rotor coaxial with a common rotational axis of, and rotatable relative to, the drive rotor and the first intermediate rotor; and a torque means adapted to provide the first control rotor with a torque so as to vary the phase angle of the camshaft relative to the drive rotor in accordance with the rotations of the first intermediate rotor and the drive rotor, wherein the torque means comprises a first electromagnetic clutch for causing the first control rotor to be rotated relative to the first intermediate rotor and the drive rotor;

a second intermediate rotor integral with the camshaft and having a substantially radial guide slit;

a second control rotor mounted coaxial with, and rotatable relative to, the first control rotor and second intermediate rotor;

a second electromagnetic clutch for rotating the second control rotor;

a first eccentric rotary mechanism that is eccentrically rotatable about the rotational axis of the camshaft in conjunction with the first control rotor;

a second eccentric rotary mechanism that is eccentrically rotatable about the rotational axis in conjunction with the second control rotor; and coupling means in sliding engagement with the radial guide slit for coupling the first and second eccentric rotary mechanisms mutually rotatable with respect to each other, wherein the first eccentric rotary mechanism comprises a first circular eccentric bore formed in the first control rotor, and a first ring member having an outer circumference in sliding contact with the inner circumference of the first circular eccentric bore;

wherein the second eccentric rotary mechanism comprises a second circular eccentric bore formed in the second control rotor, and a second ring member having an outer circumference in sliding contact with the inner circumference of the second circular eccentric bore;

wherein the coupling means comprises a first and a second engagement bores formed in the first and second ring members, respectively, and a coupling member passing through the radial guide slit with the opposite ends thereof inserted in the first and second engagement bores, respectively, and wherein the first and second ring members are arranged across a phantom extension line of the radial guide slit.

2. The camshaft phase variable device according to claim 1, wherein the first circular eccentric bore of the first control rotor has a larger distance from the rotational axis to the center axis of the first circular eccentric bore than the distance from the rotational axis to the center axis of the second circular eccentric bore of the second control rotor wherein the center axis of the first circular eccentric bore is an eccentric point of the first circular eccentric bore, wherein the center axis of the second circular eccentric bore is an eccentric point of the second circular eccentric bore, wherein the distance from the rotational axis to the center axis of the first circular eccentric bore is the eccentric radius of the first eccentric bore with respect to the rotational axis, and wherein the distance from the rotational axis to the center axis of the second circular eccentric bore is the eccentric radius of the second eccentric bore with respect to the rotational axis.

3. The camshaft phase variable device according to claim 1 or 2, wherein at least one of the first and second ring members of the camshaft phase variable device is a C-shaped ring member.

4. The camshaft phase variable device according to claim 1 or 2, wherein the radial guide slit has a length to allow the second ring member to rotate 360 degrees or more in the second circular eccentric bore.

* * * * *